US006681668B1

(12) United States Patent
Smirle

(10) Patent No.: US 6,681,668 B1
(45) Date of Patent: Jan. 27, 2004

(54) DEVICE AND PROCESS FOR THERMALLY CUTTING A MOVING WEB OF TEXTILE MATERIAL

(76) Inventor: Steven John Smirle, P.O. Box 601, Callander, Ontario (CA), P0H 1H0

( * ) Notice: Subject to any disclaimer, the term of this patent is extended or adjusted under 35 U.S.C. 154(b) by 296 days.

(21) Appl. No.: 09/702,800

(22) Filed: Nov. 1, 2000

(30) Foreign Application Priority Data

Aug. 25, 2000 (CA) ..... 2316696

(51) Int. Cl.[7] ..... B26D 7/10

(52) U.S. Cl. ..... 83/171; 83/16; 83/651.1; 219/68; 139/291 C; 139/302; 156/88

(58) Field of Search ..... 83/15, 16, 170, 83/171, 651.1; 425/292, 298; 219/221, 68, 233, 235, 243; 156/515, 251, 88; 30/140; 139/302, 291 C; 493/470, 203, 341, 194

(56) References Cited

U.S. PATENT DOCUMENTS

| | | | | | |
|---|---|---|---|---|---|
| 2,157,151 | A | * | 5/1939 | Stackhouse | 30/140 |
| 3,076,252 | A | * | 2/1963 | Hofmann | 156/88 |
| 3,320,111 | A | * | 5/1967 | Lucia et al. | 156/515 |
| 3,321,353 | A | * | 5/1967 | Zelnick | 53/374.8 |
| 3,508,378 | A | * | 4/1970 | Fehr et al. | 53/553 |
| 3,574,039 | A | * | 4/1971 | Fehr et al. | 156/515 |
| 4,259,134 | A | * | 3/1981 | Joice et al. | 156/251 |
| 4,319,952 | A | * | 3/1982 | Schjeldahl | 156/510 |
| 4,572,245 | A | * | 2/1986 | Gachsay | 139/291 C |
| 4,610,653 | A | * | 9/1986 | Savich | 493/470 |
| 4,768,411 | A | * | 9/1988 | Su | 83/170 |
| 4,798,934 | A | * | 1/1989 | Boyer | 219/233 |
| 5,015,223 | A | * | 5/1991 | Boeckmann | 493/194 |
| 5,074,951 | A | * | 12/1991 | Banco et al. | 156/515 |
| 5,085,917 | A | * | 2/1992 | Hodnett, III | 428/193 |
| 5,092,208 | A | | 3/1992 | Rosa-Miranda | 83/171 |
| 5,101,094 | A | | 3/1992 | Keller et al. | 219/221 |
| 5,115,839 | A | * | 5/1992 | Speich | 139/291 C |
| 5,452,633 | A | | 9/1995 | Speich | 83/16 |
| 5,806,393 | A | | 9/1998 | Saporiti | |
| 6,207,930 | B1 | * | 3/2001 | Diesner | 219/388 |

FOREIGN PATENT DOCUMENTS

| | | |
|---|---|---|
| CA | 1032072 | 5/1978 |

* cited by examiner

*Primary Examiner*—Boyer D. Ashley
(74) *Attorney, Agent, or Firm*—Jones,Tullar & Cooper,PC

(57) ABSTRACT

A device for cutting a moving web of textile material as it passes the device, and for sealing the cut edges of the material, having an electrically heated cutting member capable of severing the material as it passes the cutting member, and an electrically heated sealing member downstream from the cutting member relative to the direction of the moving web and positioned to contact and seal the edges of material cut by the cutting member as the edges pass over the sealing member. The sealing member is heated to a temperature somewhat higher than that of the cutting wire, the sealing member having a width larger than that of the cutting member transverse to said direction, and preferably being in the form of a cylinder. The invention also includes a process using the special cutting member/sealing member combination.

11 Claims, 4 Drawing Sheets

DEVICE AND PROCESS FOR THERMALLY CUTTING A MOVING WEB OF TEXTILE MATERIAL

BACKGROUND OF THE INVENTION

1. Field of the Invention

The present invention relates to a thermal cutter for the cutting of a moving textile material web, especially a web of textile artificial fiber or plastic material such as polyethylene or polypropylene. Such cutting is usually done as the web comes off a loom and before the web is wound. The cutting may be done to remove selvedge by cutting off outer edges of the cloth, and may also be done in central areas of the web to make narrow webs such as tapes.

2. Prior Art

The cutting of a moving web of plastic textile material is commonly done by thermal cutters such as hot wires. These have the property that in melting the material they also seal the edges and lessen the tendency of the edges of the material to unravel; unravelled edges can cause problems in winding and subsequent processing. One known thermal cutter device is that sold by Loepf Bros. Ltd (Gebruder Loepf AG) of Switzerland, under the designation "Thermocut TC-1S". In this the material is cut by an electrically heated wire having a U-shaped portion which cuts through the material as it passes in a direction generally parallel to the plane of the U-shaped portion, but which plane may be slightly off-set at an acute angle to the web direction plane. The hot wire both cuts and seals the material, with the sealing being dependent on the type of material and the angle at which the cutter is set. It is recommended by this company that the wire U-shaped portion be set parallel to the web travel direction for heavy fusing and thick edges, and at a small angle (of say 5 or 10°) to this direction for light fusing and thin edges. In my experience with the Loepf apparatus, there is a tendency among workers to ignore the recommendations concerning angles, leading to unsatisfactory sealing of the edges. Also, where a rather loose weave material is used, the sealing is often inadequate to prevent the strands of material being pulled apart by tension applied to the web.

Further examples of prior art showing this type of hot wire cutting apparatus for moving textile webs are shown in the following U.S. patents:

U.S. Pat. No. 4,572,245, issued Feb. 25, 1986 to Gachsay;

U.S. Pat. No. 5,101,094, issued Mar. 31, 1992 to Keller et al.;

U.S. Pat. No. 5,452,633, issued Sep. 26, 1995 to Speich; and

U.S. Pat. No. 5,806,393, issued Sep. 15, 1998 to Saporiti.

The Keller et al. patent is assigned to Loepf A. G., and shows various modifications of the Thermocut TC-1S design. These modification include using a wire which is relatively thin and sharp so that it can cut at temperatures not substantially higher than the melting temperature, and using a wire which is S-shaped when viewed perpendicularly to the plane of the material being cut. The devices shown in this patent still require that, for satisfactory operation, the wire be set at particular angles, so this does not meet the problem posed by operators who do not adjust the angle properly.

The Gachsay patent is concerned with a shield for preventing cooling of the wire. The Speich and Saporiti patents are concerned with special arrangements of heated wire.

All the prior art referred to above relies on the heated wire, or a part of the wire, to perform the sealing operation as the textile passes over the wire.

SUMMARY OF THE INVENTION

The present invention provides an arrangement in which reliance for sealing the cut edges of the textile is not placed on the hot wire itself or the positioning of the wire; instead a further sealing member is provided just downstream of the wire or cutting element.

In accordance with a first aspect of the invention, a device for cutting a moving web of textile material as it passes the device, and for sealing the cut edges of the material, comprises:

an electrically heated cutting member capable of severing the material as it passes the cutting member, and an electrically heated sealing member downstream from the cutting member relative to the direction of the moving web and positioned to contact and seal the edges of material cut by the cutting member as the edges passes over the sealing member, the sealing member having means for maintaining the sealing member at a suitable temperature for sealing the edges, the sealing member having a width larger than that of the cutting member transverse to the direction of the moving web. The sealing member temperature will normally be different from, and may be substantially higher than, the cutting member temperature.

The sealing member may have a convexly curved surface adjacent to but spaced from the cutting member and which contacts the cut edges as they leave the cutting member.

In accordance with another aspect of the invention, the device has:

first and second electrical terminals, and an electrically conductive wire connected between the terminals, the wire having first and second portions;

wherein a first wire portion provides a textile cutting wire which extends transversely relative to the direction of movement of the moving web;

and wherein a second wire portion provides a heating element for a sealing member having a convexly curved surface and incorporating the second wire portion; the sealing member also being disposed transversely to the web direction and immediately downstream of the cutting wire relative to the web movement.

The convexly curved surface of the sealing member is several times greater than the diameter of the cutting wire and is such that, with a current passing through the wire, the sealing member is heated to a temperature suitable for sealing the cut edges, which temperature is usually higher than that of the cutting wire and serves to seal the edges of the material cut by the wire.

Preferably, the first and second wire portions are substantially parallel and are joined by a short wire section extending between ends of the cutting wire and an adjacent end of the sealing member remote from the electrical terminals.

The sealing member preferably has a width transverse to the direction of web movement which is at least 5 times greater than the cutting member width.

The sealing member may comprise electrically insulating, thermally conductive material surrounding the second wire portion, and a metal sheath surrounding the electrically insulating material.

The invention also includes a process for the thermal cutting of a moving web of textile material, wherein the moving material is contacted firstly by a heated cutting member capable of severing the material, and immediately afterwards edges which have been cut by the cutting member are contacted by a sealing member which is separate from the cutting member and which is maintained at a temperature which is suitable for sealing the cut edges; this sealing temperature will be above the melting point of the material and may be substantially higher than that of the cutting member.

BRIEF DESCRIPTION OF THE DRAWINGS

A preferred embodiment of the invention will now be described by way of example with reference to the accompanying drawings, in which.

DETAILED DESCRIPTION

Figure 1:
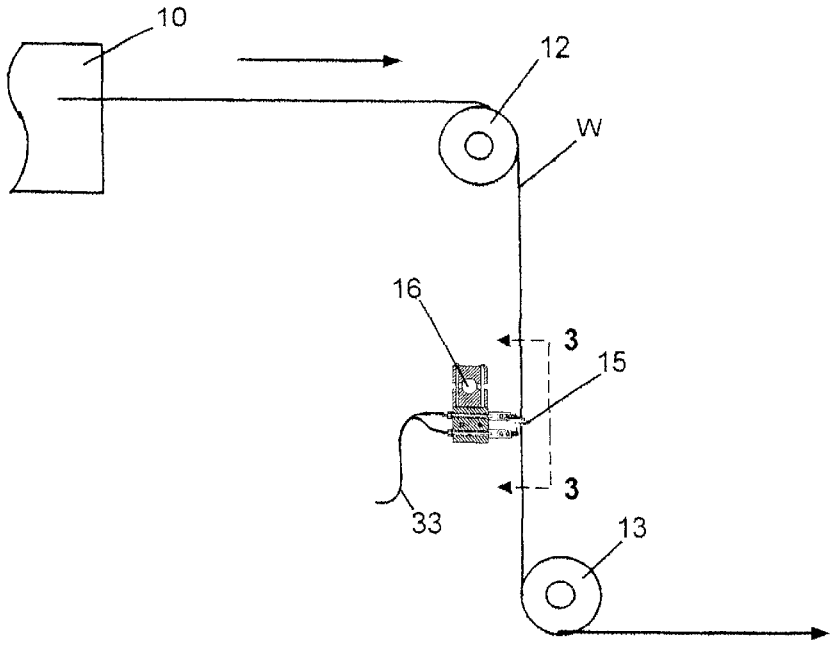
FIG. 1 is a side view of parts of a loom showing the location of the thermal cutter.

FIG. 1 shows a loom 10 producing a web W of woven plastic or artificial fibers which passes over guide rollers 12 and 13. The web moves down vertically between these rollers, and in doing so is cut by several laterally spaced, thermal cutters 15 which are the subject of this invention.

Figure 2:
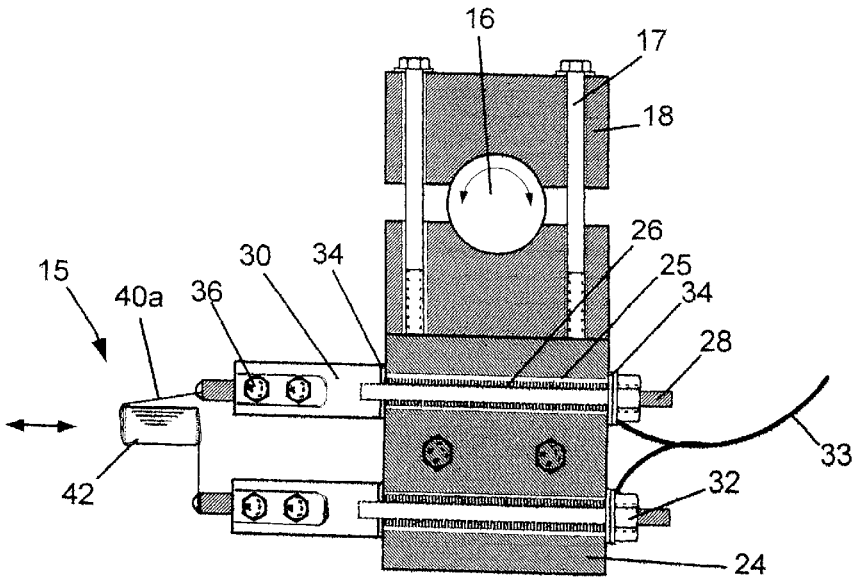
FIG. 2 is an enlarged side view of the thermal cutter and its mounting means.
Figure 3:
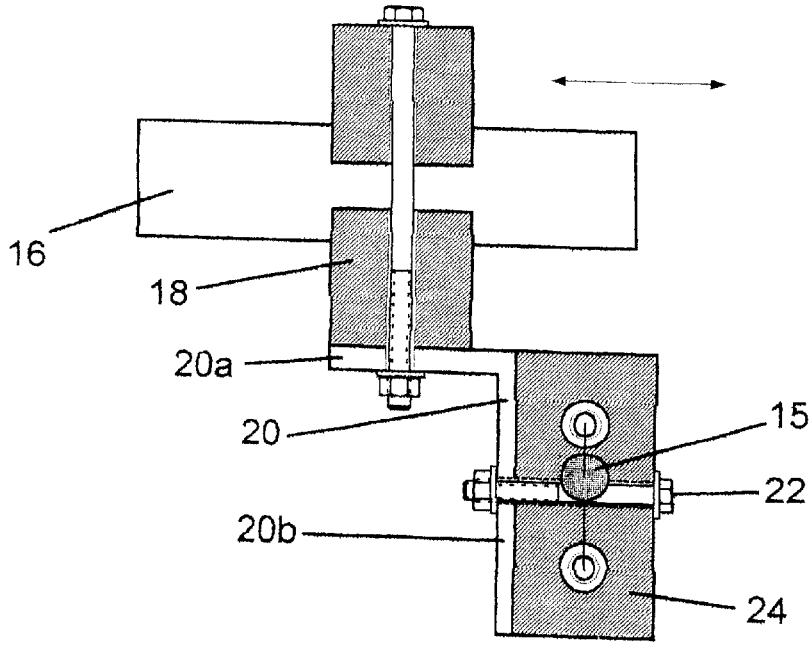
FIG. 3 is a front view of the thermal cutter and mounting means, taken on lines 3—3 of FIG. 1.
Figure 4:
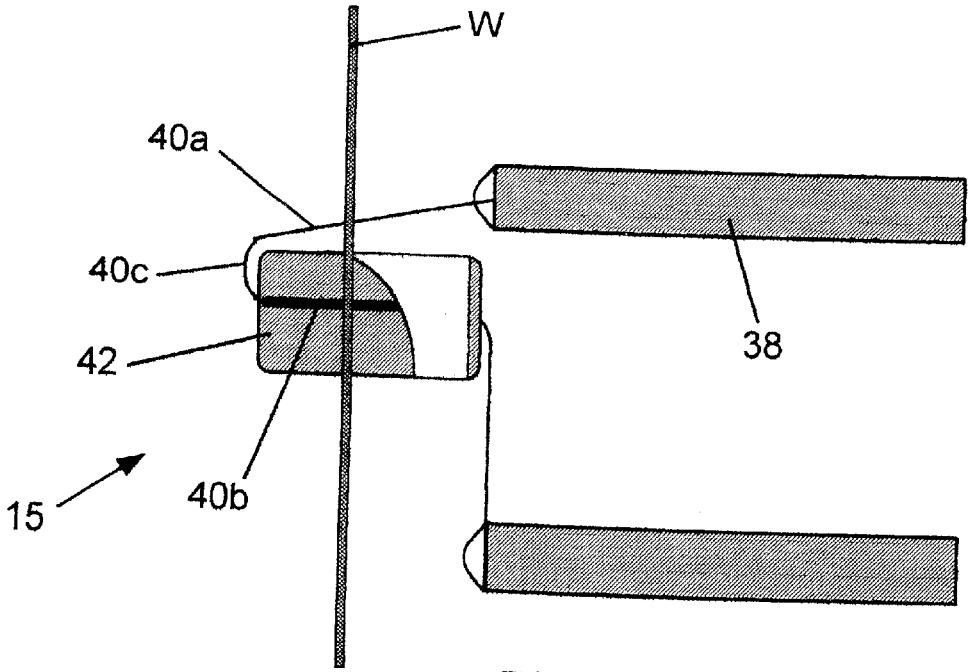
FIG. 4 is a view of the thermal cutter removed from the mounting means.
Figure 6:
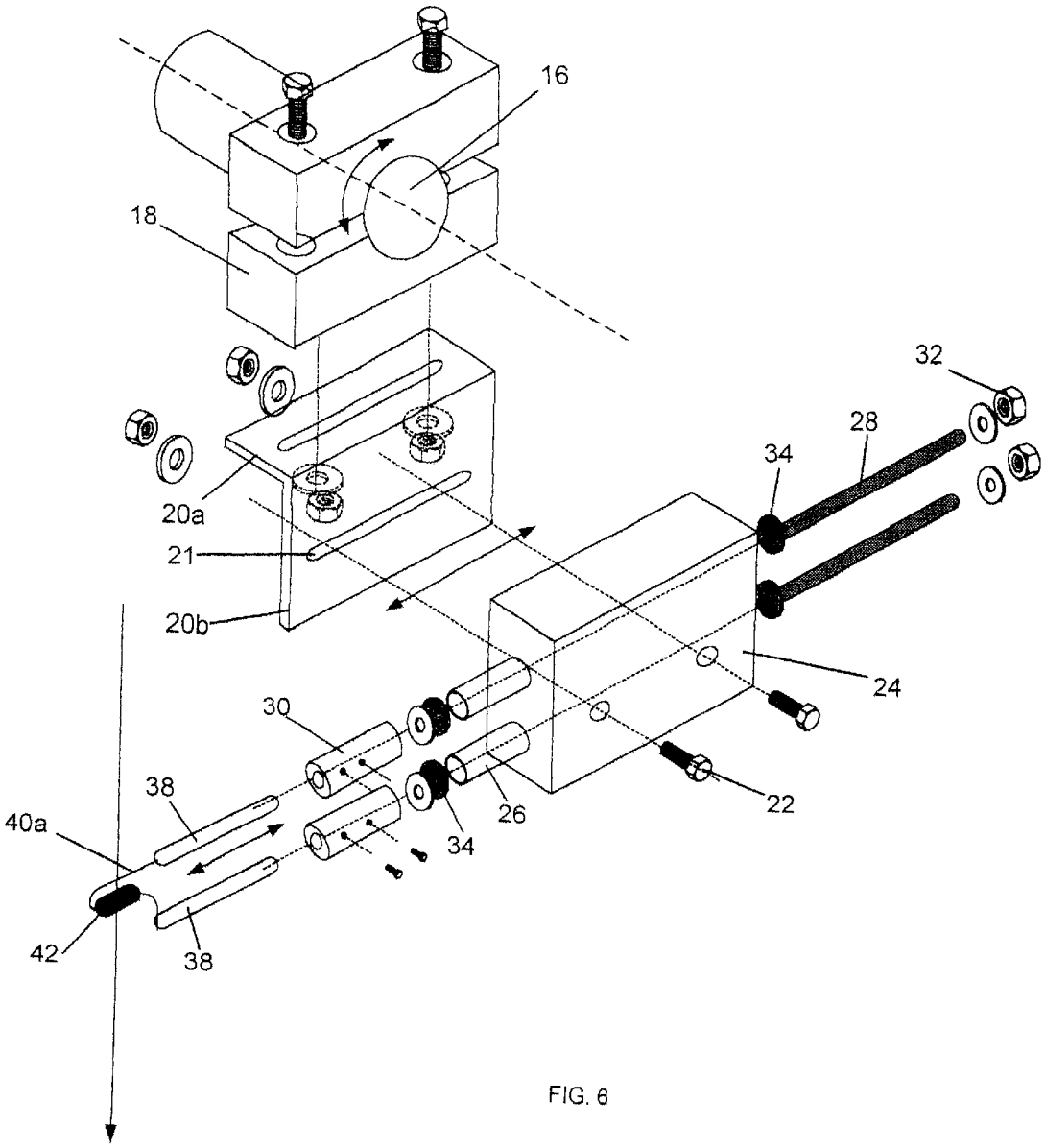
FIG. 6 is an exploded view of the apparatus.

Details of a cutter 15, and of its mounting means, are shown in FIGS. 2 to 4. As shown, the mounting means include a circular shaft 16 to which are clamped, by screws 17, the two parts of a bracket-holding clamp 18 holding one leg 20*a* of a right-angled bracket 20. The second leg 20*b* of the bracket has a longitudinal slot 21, seen in FIG. 6, by which it is attached by screws 22 to a rectangular metal block 24 holding the thermal cutter device. It will be seen from FIGS. 2, 3 and 6 that the exact position of the device in relation to the web can be adjusted by adjustment of the clamp 18 in angular position and in its position along the shaft 16, and by adjustment of the screws 22 in slot 21.

The block 24 has two parallel bores 25, each of which receives an insulating sleeve 26, and within each sleeve extends a long threaded rod 28, one end of which is threaded into a connector sleeve 30 and the other end of which has a nut 32 which provides an electrical terminal for attachment to a wire 33 connected to an electrical supply. Insulating washers 34 insulate both the connector sleeves and the nuts 32 from the block 24. Outer end portions of the connector sleeves 30 have axial bores and set screws 36 which secure inner end portions of metallic rods 38, shown separately in FIGS. 4 and 6, and which provide electrical terminals for the cutter/sealer device 15, and which is shown separated from the other parts in FIGS. 4 and 6.

The cutter/sealer device 15 itself comprises a wire 40 having a first portion 40*a* welded to the outer end of a first metallic rod 38 and which extends outwardly from the end of the rod to form the cutting member, and a second portion 40*b*, a part of which is shown in FIG. 4. This second portion is doubled back from the first portion and passes axially through a sealing member 42 and has its inner end connected to the second rod 38; the outer ends of these two wire portions 40*a* and 40*b* are connected by a short U-shaped wire portion 40*c*.

The first wire portion 40*a* which forms the cutting member extends from the rod 38 at a small angle to its axis, usually about 10 to 20°; it has a diameter of 1 mm. and a length of about 1 cm. It is positioned so that, as shown in FIG. 4, the moving web W meets it at about its longitudinal center. The second wire portion, inside the sealing member 42, is flattened to provide a heating element having a dimension of 0.5 mm by 2 mm and a length of 7 mm. This heating element is surrounded by an electrically insulating, heat conducting ceramic material; suitable material is provided by small insulating beads of porcelain ceramic threaded onto the wire. This material in turn is encased, by use of a high temperature adhesive made of zirconium oxide, in a cylindrical metal, preferably brass sheath, having a diameter of about 6 mm, and preferably between 5 mm and 1.5 mm; the larger diameter being useful for the loosest woven fabrics. The sealing member 42 is positioned close to the cutting wire 40*a*, specifically spaced by an amount less than the sealing member diameter. As will be seen especially in FIG. 4, the cylindrical surfaces of the sealing member 42 extend perpendicularly to the plane of the moving web for contacting the edges cut by the wire 40*a*.

In operation, electrical energy is supplied to the wires simultaneously with energizing of the loom. The cutting wire 40*a* reaches cutting temperature in about 2 seconds, effectively when the material starts to come from the loom. The sealing member 42 takes about 5 seconds to reach its sealing temperature of 300 to 410° F., which is acceptable. This is about 30% higher than the cutting wire temperature when these temperatures are expressed in ° F.; thus, for a 410° F. sealing member, the cutting wire temperature would be about 300° F. The wire 40*a* reaches its cutting temperature more quickly than in prior art devices where a longer length of wire is exposed to cooling by the air. Another feature of this invention is that the sealing member has a relatively large heat capacity, compared to a wire, so that its temperature does not vary as much as an exposed wire does when operating conditions are varied.

Figures 5A, 5B, 5C:
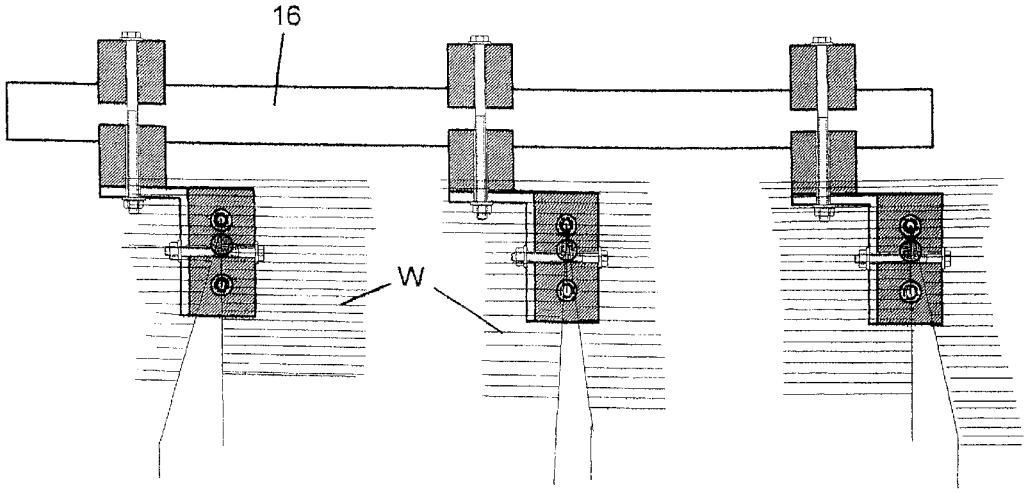
FIGS. 5*a*, 5*b*, and 5*c* are views similar to FIG. 3 showing the thermal cutter used both for edge cutting and central cutting of the web.

FIG. 5 shows the manner in which the thermal cutter of this invention can cut both a left side edge and a right side edge, as well as making a central cut in the web, without the need for any adjustment of the angle at which the device meets the web. At each of the laterally spaced locations the center of the sealing member and the cutting wire are aligned with the direction of the web movement. The device is thus much less dependent on operator knowledge than the prior art devices of Loepf AG, for example.

The device of this invention is well suited to varying weave densities of 10 weft×18 warp or greater. The cutting wire preheats the material before the sealing member seals the edges without too much melt back; this is better for high density fabric. At higher temperatures, the process is the same but the larger sealing body will provide more melting of the edge material and a stronger seal, which is an advantage on a lower density weave.

I claim:

1. A device for cutting a moving web of textile material as it passes the device, and for sealing cut edges of the material produced by said cutting, comprising;

an electrically heated cutting member capable of cutting the material as it passes the cutting member, and an electrically heated sealing member downstream from the cutting member relative to the direction of movement of the moving web and positioned to contact and seal the cut edges of material as the edges pass over the sealing member, said sealing member having means for maintaining the sealing member at a sealing temperature, the sealing member having a width larger than that of the cutting member transverse to said direction.

2. A device according to claim 1, in combination with mounting means for mounting the device adjacent a moving web of textile material.

3. A device as claimed in claim 1, wherein said sealing member has sealing surfaces extending perpendicularly to said moving web.

4. A device according to claim 1, wherein the sealing member has a convexly curved surface adjacent but spaced from the cutting member and which contacts the cut edges as they leave the cutting member.

5. A device according to claim 4, wherein the sealing member is in the form of a cylinder having its axis transverse to said direction of movement of said moving web, and having its axis perpendicular to the moving web.

6. A device according to claim 5, wherein said cylinder is spaced from the cutting member by an amount less than the sealing member diameter.

7. A device according to claim 1, and further comprising:

first and second electrical terminals, and an electrically conductive wire connected between said terminals, said wire having first and second portions, wherein said first portion of said wire provides said electrically heated cutting member, which cutting member extends transversely relative to the direction of movement of the moving web and which is capable of cutting the material as it passes said cutting member;

and wherein the said second portion of said wire provides a heating element for said electrically heated sealing member, which sealing member incorporates said second portion of said wire; said sealing member also being disposed transversely to the said web direction and immediately downstream of the cutting wire relative to said direction of movement of the moving web, said sealing member having a convexly curved surface which is several times greater than the diameter of the cutting wire and being such that, with a current passing through the wire, the sealing member is heated to a temperature suitable for sealing the cut edges.

8. A device according to claim 7, wherein said first and second portions of said wire are substantially parallel and are joined by a short wire section extending between adjacent ends of the cutting wire and of the sealing member remote from the electrical terminals.

9. A device according to claim 7 wherein said sealing member has a width transverse to the said direction of movement of the moving web which is at least 5 times greater than the cutting member width.

10. A device according to claim 9, wherein the sealing member comprises electrically insulating, thermally conductive material surrounding the second portion of said wire, and a metal sheath surrounding the electrically insulating material.

11. A device according to claim 7, wherein said electrically heated cutting member provided by said first portion of said wire, and the heating element of the sealing member provided by the second portion of said wire, are such that with an electrical current passing through the wire the temperature of the sealing member is higher than that of the cutting member.

* * * * *